United States Patent [19]

Kato et al.

[11] Patent Number: 4,852,341

[45] Date of Patent: Aug. 1, 1989

[54] BELT TYPE FALSE TWISTER

[75] Inventors: Hisaaki Kato, Shiga; Hideshi Mori, Joyo, both of Japan

[73] Assignee: Murata Kikai Kabushiki Kaisha, Kyoto, Japan

[21] Appl. No.: 180,992

[22] Filed: Apr. 13, 1988

[30] Foreign Application Priority Data

Apr. 16, 1987 [JP] Japan ..... 62-93829

[51] Int. Cl.[4] ..... D01H 5/28; D02G 1/04

[52] U.S. Cl. ..... 57/328; 57/331; 57/336

[58] Field of Search ..... 57/328, 336, 5, 6, 350, 57/224, 331

[56] References Cited

U.S. PATENT DOCUMENTS

| | | | |
|---|---|---|---|
| 2,262,589 | 11/1941 | Peck | 57/336 X |
| 2,863,280 | 12/1958 | Ubbelohde | 57/336 X |
| 2,991,614 | 7/1961 | Ubbelohde | 57/336 |
| 3,045,416 | 7/1962 | Ubbelohde | 57/336 X |
| 4,377,932 | 3/1983 | Dammann et al. | 57/336 |
| 4,400,931 | 8/1983 | Maeda | 57/336 |
| 4,408,448 | 10/1983 | Bauer et al. | 57/336 |
| 4,492,075 | 1/1985 | Faure | 57/5 |
| 4,674,274 | 6/1987 | Kato | 57/328 |

*Primary Examiner*—John Petrakes

*Attorney, Agent, or Firm*—Spensley Horn Jubas & Lubitz

[57] ABSTRACT

The belt type false twister, in which a pair of pulleys with two travelling endless belts entrained thereabout are mounted fixedly, and in a position off the fiber nipping point of one endless belt there is disposed a roller for urging the said one endless belt toward the other endless belt, a linear travelling portion of the one endless belt being bent and allowed to come close to the other endless belt by the said roller to nip fibers between the closely adjacent belt portions.

20 Claims, 1 Drawing Sheet

BELT TYPE FALSE TWISTER

FIELD OF THE INVENTION

The present invention relates to a belt type false twister for false-twisting fibers by nipping the fibers between two crossed belts travelling in directions different from each other.

RELATED ART STATEMENT

Such belt type false twister is, for example, as shown in FIG. 4 wherein endless belts 7 and 8 are entrained about pulleys 3, 4 and 5, 6 projecting rotatably from frames 1 and 2, respectively, which intersect substantially perpendicularly to each other, one frame 2 being fixed and the other 1 rotatable about a shaft 9, and fibers are passed through the intersecting position of both belts 7 and 8 to false-twist the fibers.

Such belt type false twister has a basic merit that since fibers are nipped and twisted directly between the belts, the twisting efficiency is high as compared with the energy required for drive. But at the same time it has a demerit that with variation in nipping pressure, the twisting efficiency is also apt to vary largely. In the conventional device shown in FIG. 4, not a small variation in twisting efficiency has occurred.

Having made earnest studies about the aforementioned conventional device, the present inventor succeeded in clearing up the cause of such variation in nipping pressure and thus reached the present invention. More particularly, in the conventional device as shown in FIG. 4, a hydraulic cylinder 11 is connected at 12 to the rotatable frame 1 to urge the latter in the direction of arrow A by virtue of the extending force of the cylinder 11, thereby creating pressure for nipping the fibers between the belts. In such a construction wherein either the frame 1 or 2 is made rotatable, the difference of the amount of slip between one pulley on the rotatable frame, here the frame 1, and the belt 7 from the amount of slip between the other pulley 4 and the belt 7, acts as a rotating moment for the frame 1. Consequently, even if the urging pressure of the hydraulic cylinder 11 is maintained strictly at a constant force F, the addition of such indefinite moment, indicated at f, results in variation of the nipping pressure.

The difference of the amount of slip between the pulley 3 and the belt 7 from that between the pulley 4 and the belt 7 is caused not only by the difference in the coefficient of friction therebetween but also by the variation in the position of contact of the belt with the pulleys 3 and 4 in the case where the pulleys are formed with flanges at both ends (that is, the variation between the state of the belt 7 being wholly in contact with the small-diameter portions of the pulleys 3 and 4 and the state of the belt 7 being in contact at end faces thereof with the flange surfaces of the pulleys 3 and 4).

Further, the difference in the coefficient of rotational friction of the bearing shafts of the pulleys 3 and 4 relative to the frame 1 is also presumed to be a cause of occurrence of the foregoing indefinite moment f for the frame 1.

OBJECT AND SUMMARY OF THE INVENTION

It is an object of the present invention to provide a novel belt type false twister capable of minimizing the variation in nipping pressure which is a direct cause of variation of the twisting effect.

According to the belt type false twister of the present invention, a pair of pulleys with two travelling endless belts entrained thereabout are mounted fixedly, and in a position off the fiber nipping point of one endless belt there is disposed a roller for urging the said one endless belt toward the other endless belt, a linear travelling portion of the one endless belt being bent and allowed to come close to the other endless belt by the said roller to nip fibers between the closely adjacent belt portions.

DETAILED DESCRIPTION OF PREFERRED EMBODIMENTS

Figures 1, 2, 3, 4:
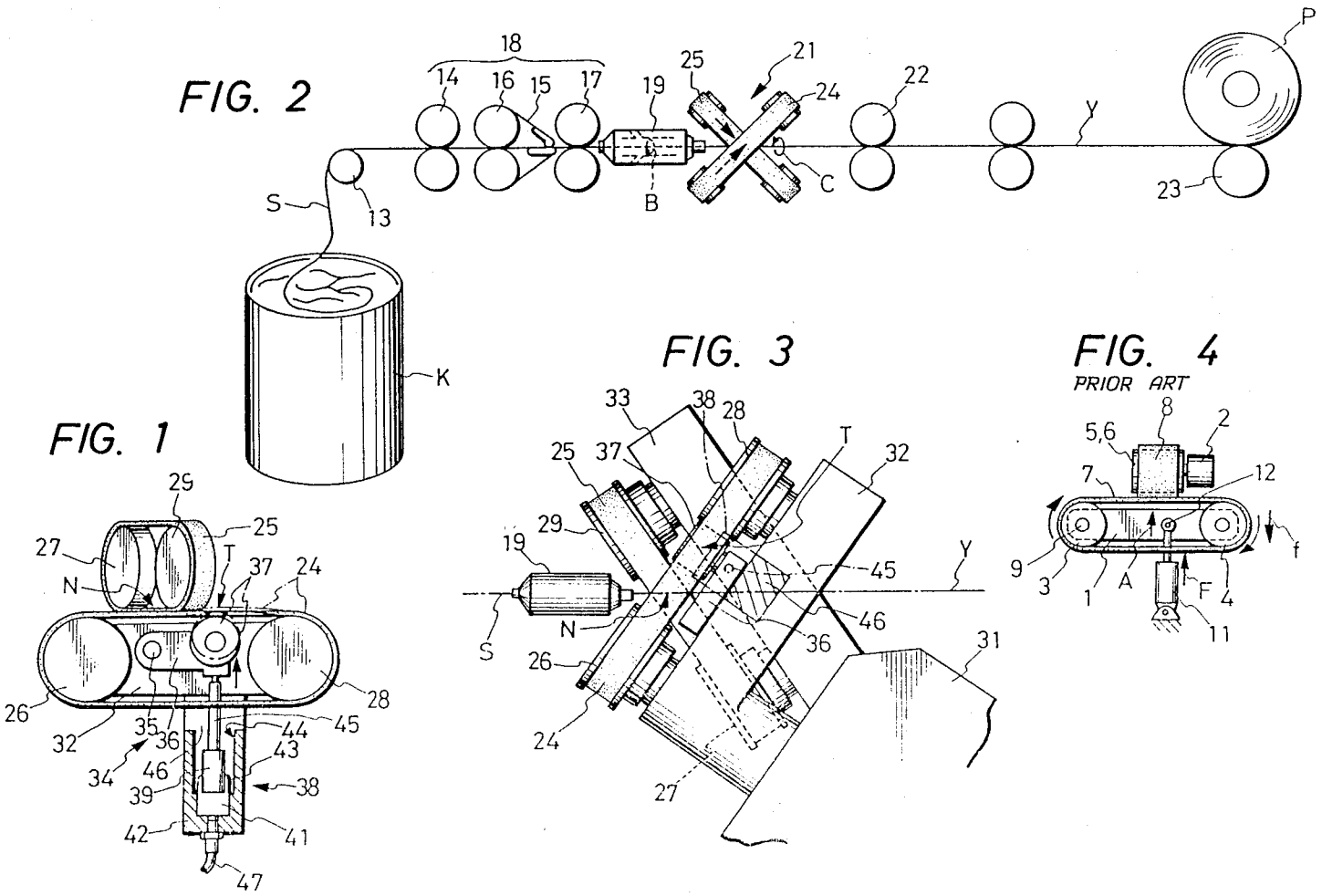
FIG. 4 PRIOR ART
FIG. 1 is a front view of a belt type false twister according to an embodiment of the present invention.
FIG. 2 is a schematic constructional diagram of a spun yarn manufacturing apparatus using the belt type false twister of FIG. 1 as a second false twister.
FIG. 3 is a side view of the belt type false twister of FIG. 1.
FIG. 4 is an explanatory view showing a conventional device.

The following description is now provided about an example of using the belt type false twister of the present invention as a second false twister in a spun yarn manufacturing apparatus.

In FIG. 2, a twistless sliver or a fiber bundle S drawn out from a can K after processing in a drawing frame passes a guide roller and is then introduced into a drafting device 18 comprising back rollers 14, middle rollers 16 each having an apron 15, and front rollers 17. The fiber bundle S thus drafted further passes through an air injection nozzle 19 as a first false twister and then through a belt type false twister 21 as a second false twister, then is drawn out by delivery rollers 22 and wound up onto a package P which is rotated by a friction roller 23.

The air injection nozzle 19 ejects a current of compressed air turning in the direction of arrow B to vibrate the fiber bundle S which was drafted in the drafting device 18, with a nipping point of the front rollers 17 as a fixed point, thereby forming balloon turning also in the direction of arrow B.

In the belt type false twister 21, as shown in detail in FIGS. 1 and 3, two endless belts 24 and 25 crossing each other in a generally X shape are respectively stretched between and entrained about driving pulleys 26, 27 and driven pulleys 28, 29. The pulleys 26, 27, 28 and 29 are supported rotatably through bearings on arm-like frames 32 and 33 projecting fixedly from a machine frame 31. The endless belts 24 and 25 are driven in the arrowed direction in the figure to false-twist the fiber bundle in the direction of arrow C.

The spacing between the driving pulleys 26, 27 and the driven pulleys 28, 29 is urged in an expanding direction by means of a known tension device. It is required to permit the disposing of a later-described pressing roller device 34 between the driving pulley 26 and the driven pulley 28. Preferably, the said spacing is large.

The position and direction of the pulleys 26, 27 and 28, 29 are set so that when the belts 24 and 25 are entrained naturally about the pulleys 26, 27 and 28, 29, there remains a slight gap therebetween. And the following pressing roller device 34 is disposed between one pulleys 26 and 28.

A lever 36 is mounted on one arm-like frame 32 pivotably through a pin 35 and a roller 37 is mounted rotatably on a free end of the lever 36. When the lever 36 is urged in the arrowed direction in FIG. 1 by means of an air cylinder 38, the roller 37 comes into rolling contact with the inner surface of the belt 24 to bend and move the belt 24 into contact with the other belt 25 (as indicated by chain line in FIG. 1).

The position T of rolling contact of the roller 37 with the belt 24 is set to a position off the intersecting position of the belts 24 and 25, that is, off the fiber nipping position N, so that the urging force of the roller 37 may not be exerted directly on the nipping position N. By virtue of the offset position T, with respect to the nipping position N in the rhombic shaped belt intersecting area (best shown in FIG. 3), a graduation or incline in nipping pressure occurs across the rhombic shaped belt intersecting area. This nipping pressure inclines or increases across the rhombic-shaped belt intersecting area and is greatest towards the edge of the intersecting area which is closest to the offset position T and least towards the edge of the intersecting area which is farthest from the offset position T. It is preferable that the amount of deviation of the rolling contact position T from the nipping position N be as large as possible. This is because the greater the distance from the nipping position N, the smaller the urging force component of the roller 37 applied directly to the nipping position N, so even a slight variation in the extending force of the air cylinder 38 is diminished.

The air cylinder 38 used in this embodiment is of such a structure as shown in FIG. 1. According to the illustrated structure, an air cylinder 41 behind the piston 39 is defined by a rubber diaphragm 43 stretched between the piston 39 and a housing 42 of the air cylinder 38. Further, the housing 42 has an opening 44 which is large as compared with a piston rod 45. So the piston 39 is substantially supported loosely at both ends thereof by the connection at the front end of the rod 45 to the lever 36 and the rubber diaphragm 43, so that it can move smoothly not only in the extending and withdrawing directions but also in the direction perpendicular thereto. It is thereby intended that the urging force to the lever 36 be as constant as possible.

Numeral 46 denotes a bracket for mounting the air cylinder 38 to the frame 32, and numeral 47 denotes air supply pipe.

The pressure to be supplied to the air cylinder 41 can be adjusted multistepwise or steplesswise using a known means.

In the above spun yarn manufacturing apparatus, the fiber bundle S introduced into the belt type false twister 21 after passing through the drafting device 18 and then through the air injection nozzle 19 is nipped between the belts 24 and 25 and thereby false-twisted. In this case, even if the fiber bundle S is an aggregate of short fibers and is very sensitive to variations in nipping pressure, the false twisting is effected always at a constant number of twists because the nipping pressures on the fibers in the above belt type false twister 21 scarcely varies, thus affording good yarn Y with little unevenness, which is wound up onto the package P.

It goes without saying that the belt type false twister of the present invention is employable as a false twisting unit not only in the above spun yarn manufacturing apparatus but also, for example, in a false twisting equipment for chemical synthetic fibers or a drawing and false twisting equipment.

As set forth above, the belt type false twister of the present invention can fully exhibit its advantage that the nipping pressure scarcely varies so fibers are directly nipped and false-twisted, thus affording a high twisting efficiency. It can false-twist all kinds of fibers (even an aggregate of short fibers) at a high efficiency. It can false-twist all kinds of fibers (even an aggregate of short fibers) at a high efficiency and at a constant number of twists.

What is claimed is:

1. A belt type false twister for false-twisting fibers by nipping the fibers at a nipping area between two crossed endless belts travelling in directions different from each other, characterized in that a pair of pulleys with said endless belts entrained thereabout are mounted fixedly and that in a position offset from said nipping area of one endless belt there is provided a pressing roller device which urges said one endless belt toward the other endless belt to provide an inclining nipping pressure across the nipping area during a false-twisting operation.

2. The belt type false twister as claimed in claim 1, wherein the pressing position where the pressing roller device contacts with the endless belt is set to be away from the nipping area and to be close to one of said pulleys and further from another one of said pulleys so that the distance between the nipping area and the pressing position is made large.

3. The belt type false twister as claimed in claim 2, wherein the nipping area is deviated from a center of the pulleys at both sides and is arranged toward the pulley which is located further from the pressing roller device so that the distance between the nip area and the pressing position is made large.

4. The belt type false twister as claimed in claim 1, wherein said endless belts are entrained about the pulleys to remain a slight gap therebetween.

5. The belt type false twister as claimed in claim 4, wherein said pressing roller device comprises a lever mounted pivotably through a pin on one frame supporting the pulleys, a roller mounted rotatably on a free end of the lever, and a means for urging the lever so that the roller comes into rolling contact with the inner surface of the belt to bend and move the belt into contact with the other belt.

6. The belt type false twister as claimed in claim 5 wherein said means for urging the lever is an air cylinder.

7. The belt type false twister as claimed in claim 6, wherein a piston rod of said air cylinder is connected with the free end of the lever and a piston connected with the piston rod is supported by a rubber diaphragm stretched between the piston and a housing of the air cylinder.

8. A spun yarn producing apparatus comprising a drafting device having back rollers, middle rollers each having an apron, and front rollers, a first false twister including an air injection nozzle, and a second false twister to impart a turning motion to a fiber bundle in an opposite direction to that of the first twister, characterized in that said second twister is a belt type false twister for false-twisting fibers by nipping the fibers at a nipping area between two crossed endless belts travelling in directions different from each other, wherein a pair of pulleys with said endless belts entrained thereabout are mounted fixedly and that in a position offset from said nipping area of one endless belt there is provided a pressing roller device which urges said one endless belt toward the other endless belt to provide an inclined nipping pressure across the nipping area during a false-twisting operation.

9. A belt-type false-twister device for false-twisting fibers, comprising:

a first belt defining a first belt path;

a second belt defining a second belt path arranged to cross the first belt path and to provide a nipping area for nipping fibers, said nipping area being defined by a portion of each belt path which is crossed by the other belt path, said nipping area having a first edge and a second edge opposite to the first edge;

nipping pressure providing means for providing a nipping pressure variance across said nipping area during a false twisting operation with a relatively low nipping pressure occurring at said first edge of the nipping area and a greater nipping pressure occurring at said second edge of the nipping area.

10. A belt-type false-twister device as claimed in claim 9, wherein said nipping pressure providing means provides a nipping pressure which is least intense at said first edge and constantly increases in intensity towards said second edge.

11. A belt-type false-twister device as claimed in claim 10, wherein said nipping pressure providing means comprises:

a belt contacting device arranged to contact said first belt at a location in said first belt path which is adjacent said first edge and offset from said nipping area;

forcing means operatively connected with said belt contacting device, for forcing the first belt toward the second belt.

12. A belt-type false-twister device as claimed in claim 11, wherein said belt contacting device comprises a rotatable roller.

13. A belt-type false-twister device as claimed in claim 12, wherein said forcing means comprises an air cylinder.

14. A belt-type false-twister device as claimed in claim 13, wherein said air cylinder comprises a housing, a piston rod, and a rubber diaphragm stretched between the piston and the housing for supporting the piston within the housing.

15. A belt-type false-twister device for false twisting fibers nipped in a nipping area between first and second endless belts, the first and second endless belts defining first and second belt paths, respectively, arranged to cross each other and provide a nipping area defined by a portion of each belt path which is crossed by the other belt path, said device comprising:

a belt contacting device arranged to contact the first endless belt in the first belt path adjacent one side of the nipping area and offset from the nipping area;

forcing means, operatively connected with said belt contacting device, for forcing the first belt toward the second belt and for providing a nipping pressure variance across the nipping area during a false twisting operation with a greater nipping pressure occurring in the nipping area closer to said one side and a lower nipping pressure occurring at the side of the nipping area which is opposite to said one side.

16. A belt-type false-twister device as claimed in claim 15, wherein said forcing means provides a nipping pressure which is least intense at said side opposite to said one side of the nipping area and constantly increases in intensity toward said one side of the nipping area.

17. A belt-type false-twister device as claimed in claim 16, wherein said belt contacting device comprises a rotatable roller.

18. A belt-type false-twister device as claimed in claim 17, wherein said forcing means comprises a fluid cylinder device.

19. A belt-type false-twister device as claimed in claim 18, wherein said fluid cylinder device comprises a housing, a piston rod, and a rubber diaphragm arranged between said piston rod and said housing for supporting said piston rod within said housing.

20. A method of false twisting fibers, comprising the steps of:

nipping the fibers at a nipping area between two crossed endless belts;

contacting one belt with a pressing device at a location on said one belt which is adjacent one side of said nipping area and offset from said nipping area; and forcing said one belt toward the other belt to provide a nipping pressure variance across the nipping area during false twisting with a greater nipping pressure occurring at said nipping area closer to said one side and a lower nipping pressure occurring at said nipping area closer to the side opposite said one side.

* * * * *